US012441445B2

(12) United States Patent
Godoy

(10) Patent No.: US 12,441,445 B2
(45) Date of Patent: Oct. 14, 2025

(54) DEVICE FOR CONNECTING A BREATHING TUBE TO A SNORKELLING MASK

(71) Applicant: CRESSI-SUB S.P.A., Genoa (IT)

(72) Inventor: Carlos Alberto Godoy, Genoa (IT)

(73) Assignee: CRESSI-SUB S.P.A., Genoa (IT)

( * ) Notice: Subject to any disclaimer, the term of this patent is extended or adjusted under 35 U.S.C. 154(b) by 745 days.

(21) Appl. No.: 17/725,093

(22) Filed: Apr. 20, 2022

(65) Prior Publication Data

US 2022/0340245 A1 Oct. 27, 2022

(30) Foreign Application Priority Data

Apr. 23, 2021 (IT) ..... 102021000010400

(51) Int. Cl.
*B63C 11/16* (2006.01)
*B63C 11/12* (2006.01)

(52) U.S. Cl.
CPC ..... *B63C 11/16* (2013.01); *B63C 11/12* (2013.01)

(58) Field of Classification Search
CPC ..... B63C 11/00; B63C 11/02; B63C 11/12; B63C 11/16; B63C 11/18; B63C 11/20; B63C 11/205; B63C 11/207; B63C 2011/126; B63C 2011/165
See application file for complete search history.

(56) References Cited

U.S. PATENT DOCUMENTS 7,222,621 B1 * 5/2007 Wung ..... B63C 11/205 128/201.27
11,021,221 B2 6/2021 Godoy
2010/0269822 A1 * 10/2010 Shiue ..... B63C 11/205 128/202.27
2015/0135482 A1 * 5/2015 Kuo ..... B63C 11/205 24/3.12
2018/0065719 A1 * 3/2018 Liao ..... B63C 11/14
2019/0225312 A1 * 7/2019 Barone ..... B63C 11/205
2019/0329853 A1 * 10/2019 Zheng ..... G03B 17/08
(Continued)

FOREIGN PATENT DOCUMENTS

CN 206087242 U * 4/2017 ..... B63C 11/14
CN 110641656 A 1/2020
IT 1020180007235 A 7/2018

OTHER PUBLICATIONS

European Search Report and Written Opinion dated Sep. 19, 2022 issued in European Patent Application No. 22164030.3.

*Primary Examiner* — Colin W Stuart
(74) *Attorney, Agent, or Firm* — TROUTMAN PEPPER LOCKE LLP

(57) ABSTRACT

A mask for the activity of surface snorkelling including a breathing tube, a rigid frame having a connection terminal for removably connecting the breathing tube, a transparent visor, a soft face shield applicable so as to be tightly sealed against the user's face and having a diaphragm which delimits an upper viewing chamber shaped so as to contain the user's eyes and a lower breathing chamber shaped so as to contain the user's nose and mouth, wherein the breathing tube is snap locked to the terminal, comprising an oscillatable lever provided with a hooking tooth engageable in a hooking seat provided on the terminal, wherein the oscillatable lever is fashioned in a separate body removeably fixed to the breathing tube and having a limiter for limiting the oscillation stroke of the oscillatable lever.

15 Claims, 5 Drawing Sheets

(56) References Cited

U.S. PATENT DOCUMENTS

| | | | | |
|---|---|---|---|---|
| 2020/0017179 | A1* | 1/2020 | Godoy | B63C 11/16 |
| 2020/0102059 | A1* | 4/2020 | Wung | B63C 11/16 |
| 2021/0129958 | A1* | 5/2021 | Sorigue | B63C 11/16 |

* cited by examiner

DEVICE FOR CONNECTING A BREATHING TUBE TO A SNORKELLING MASK

CROSS REFERENCE TO RELATED APPLICATIONS

This application claims benefit of priority to Italian Patent Application No. 102021000010400, filed Apr. 23, 2021, the entire contents of which are hereby incorporated by reference.

FIELD

The present invention relates to a mask for the activity of surface snorkelling comprising a breathing tube.

BACKGROUND

A mask for surface snorkelling of the known type features a rigid frame, a transparent visor, a soft face shield applicable so as to be tightly sealed against the face, a breathing tube with a float valve, and a strap applicable around the head to keep the mask in position.

In a known type of masks for surface snorkelling, the breathing tube is connected to the main body of the mask with a removable means in order to decrease the volume to facilitate storage and transport of the mask.

Patent IT 102018000007235 of the present applicant also discloses a mask of this type.

The means traditionally used comprise a suitably configured terminal on the body of the mask and a snap-engageable elastic means of mating shape fashioned in the breathing tube terminal.

The breathing tube is traditionally made in one piece by moulding or injection of rigid plastic materials, typically polycarbonate, in which the means for removable coupling and engagement with the terminal of the body of the mask are monolithically produced and configured.

The removable coupling and engagement means thus produced are notoriously scarcely effective, since the material with which the tube is made has high rigidity, which is in contrast with the need for an elastic engagement, and above all disengagement, of the tube terminal from the terminal of the mask body.

This traditional configuration notoriously implies that, in the case of forcing or damage of the engagement means, the entire monolithically produced breathing tube will require complete replacement.

A further limit of the known configuration of the breathing tubes thus produced is the fact that, if coloured pigments are introduced—for commercial reasons—into the polycarbonate from which the breathing tube is moulded, the shrinkage characteristics of the material will be significantly altered, compromising the quality of the removable coupling and engagement of the tube terminal with the mask terminal.

It is known, moreover, that such shrinkage characteristics vary further with variations in the colour of the pigment used.

A need is thus felt to improve the structure of the known means of engagement of breathing tubes with the body of a snorkelling mask.

SUMMARY

The technical task of the present invention, therefore, is to provide a mask for the activity of surface snorkelling comprising a breathing tube which enables the aforementioned technical drawbacks of the prior art to be eliminated.

In the context of this technical task, one object of the invention is to provide a mask for the activity of surface snorkelling comprising a breathing tube with an effective, simple, reliable and safe means for removably engaging with the terminal of the mask body.

Another object of the invention is to provide a mask for the activity of surface snorkelling comprising a breathing tube with a means for removably engaging with the terminal of the mask body which is effective irrespective of the pigments introduced into the material for moulding the breathing tube.

Yet a further object of the invention is to provide a mask for the activity of surface snorkelling comprising a breathing tube with a means for removably engaging with the terminal of the mask body which is easy to connect and remove elastically.

The technical task, as well as these and other objects, are achieved according to the present invention by providing a mask for the activity of surface snorkelling comprising a breathing tube, a rigid frame having a connection terminal for removably connecting said breathing tube, a transparent visor, a soft face shield applicable so as to be tightly sealed against the user's face and having a diaphragm which delimits an upper viewing chamber shaped so as to contain the user's eyes and a lower breathing chamber shaped so as to contain the user's nose and mouth, and a snap locking means for locking said breathing tube to said terminal, comprising an oscillatable lever provided with a hooking tooth engageable in a hooking seat provided on said terminal, characterised in that said oscillatable lever is fashioned in a separate body removably fixed to said breathing tube and having a limiter for limiting the oscillation stroke of said lever.

In one embodiment, the separate body is made of a less rigid material than the breathing tube.

In one embodiment, the separate body has an outer frame delimiting a compartment for positioning the lever, and two aligned bridges which extend towards the inside of the compartment and connect the lever to the frame.

In one embodiment, the bridges are aligned along a rotation axis of the lever and are formed from thinned portions of the separate body which act as elastic joints.

Other features of the present invention are defined, moreover, in the subsequent claims.

BRIEF DESCRIPTION OF THE DRAWINGS

Additional features and advantages of the invention will become more apparent from the description of a preferred but not exclusive embodiment of a mask for the activity of surface snorkelling comprising a breathing tube according to the invention, illustrated by way of non-limiting example in the appended drawings, in which.

DETAILED DESCRIPTION

Figure 1:
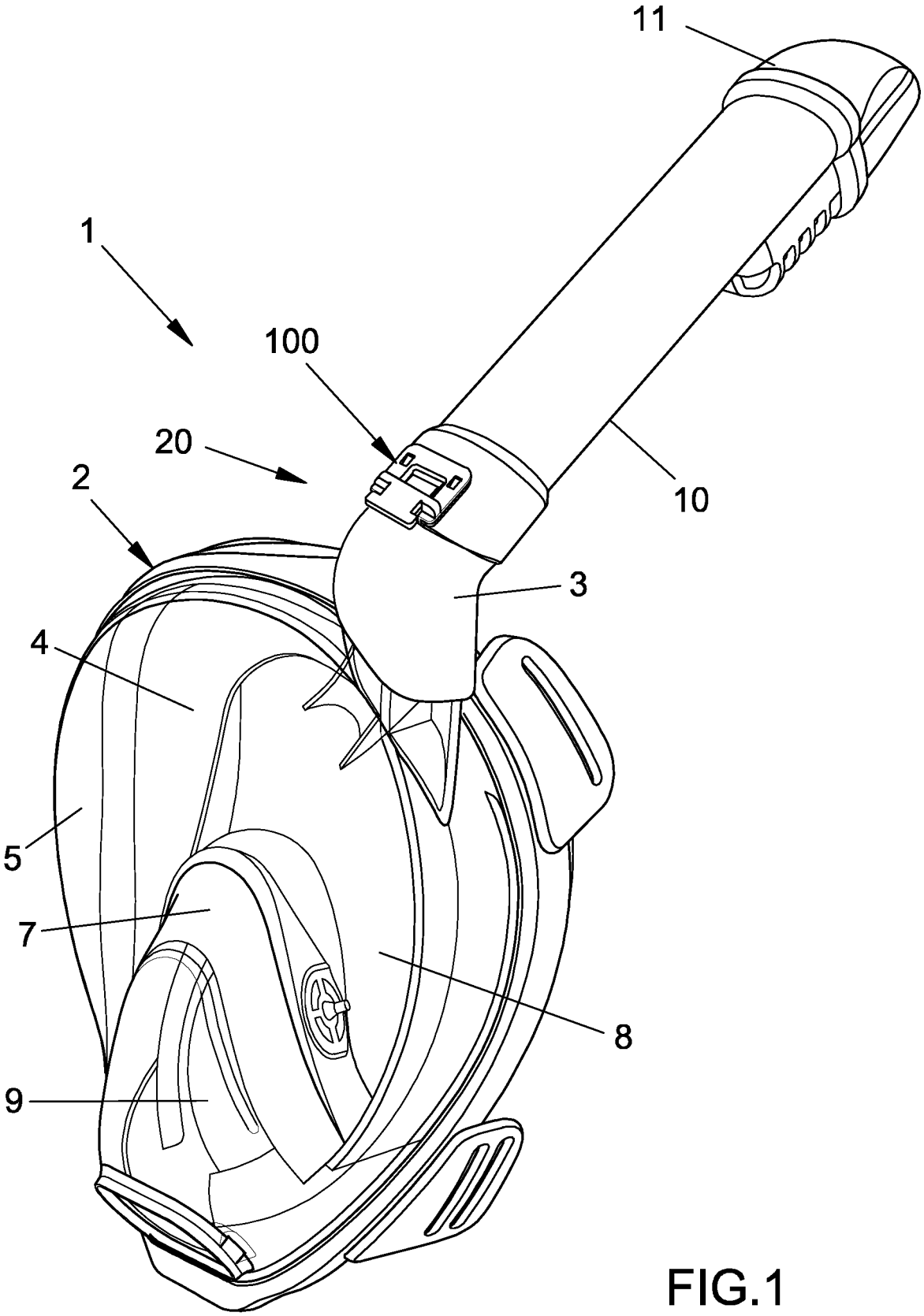
FIG. 1 shows a front perspective view of the mask.
Figure 2:
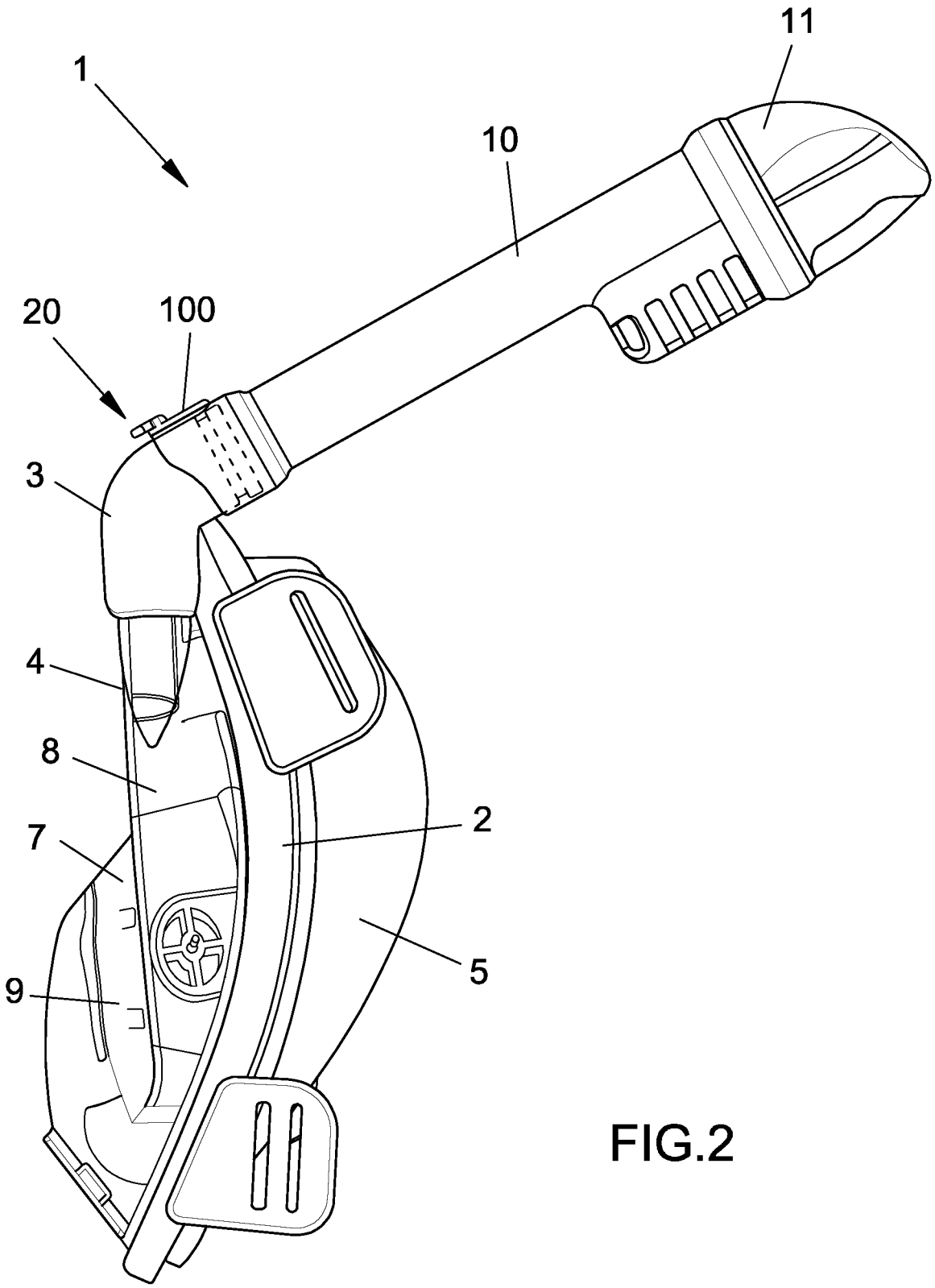
FIG. 2 shows a side view of the mask.
Figure 3:
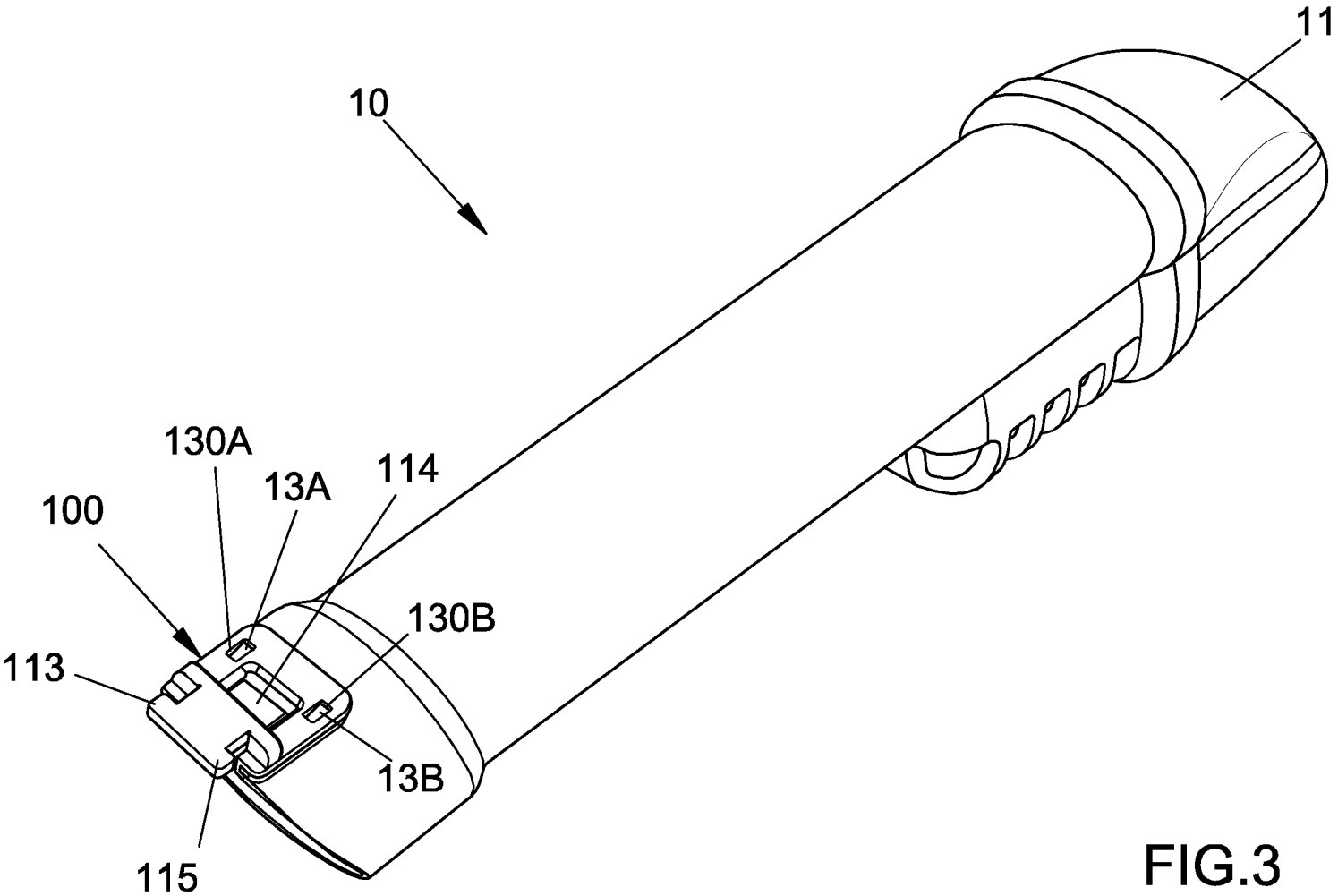
FIG. 3 shows a perspective view of the breathing tube.
Figure 5A:
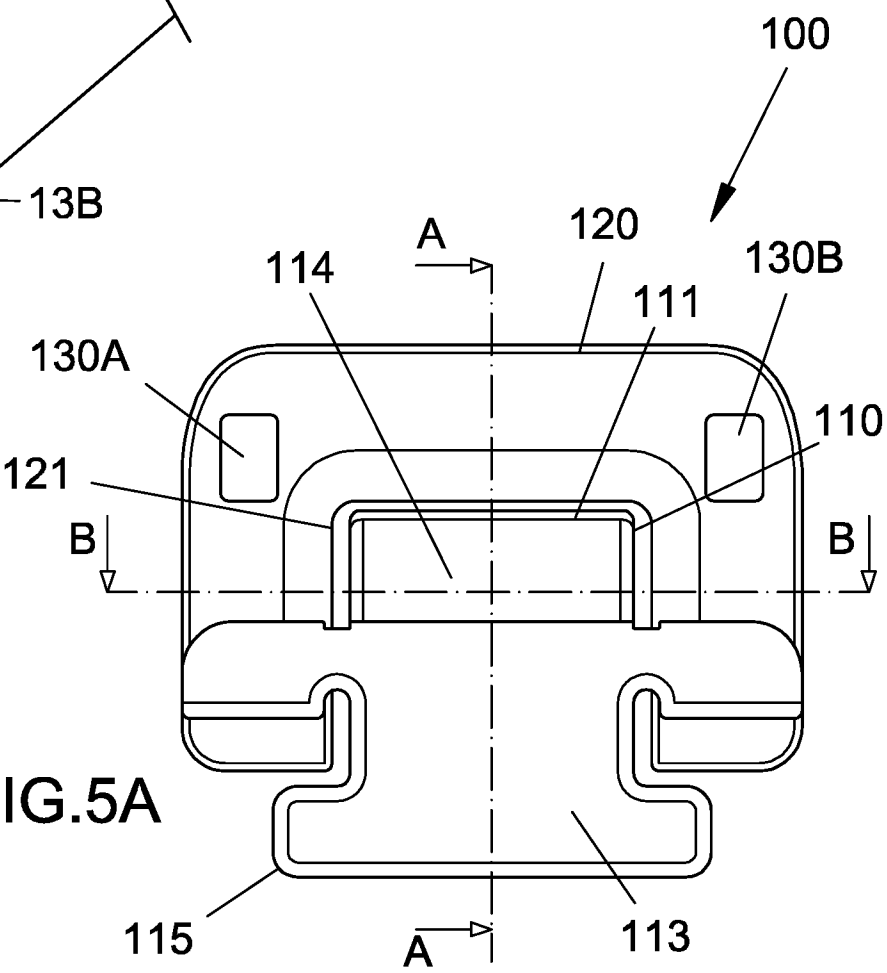
FIG. 5A shows a front view of the hooking means for hooking the breathing tube to the terminal of the mask body.
Figure 4:
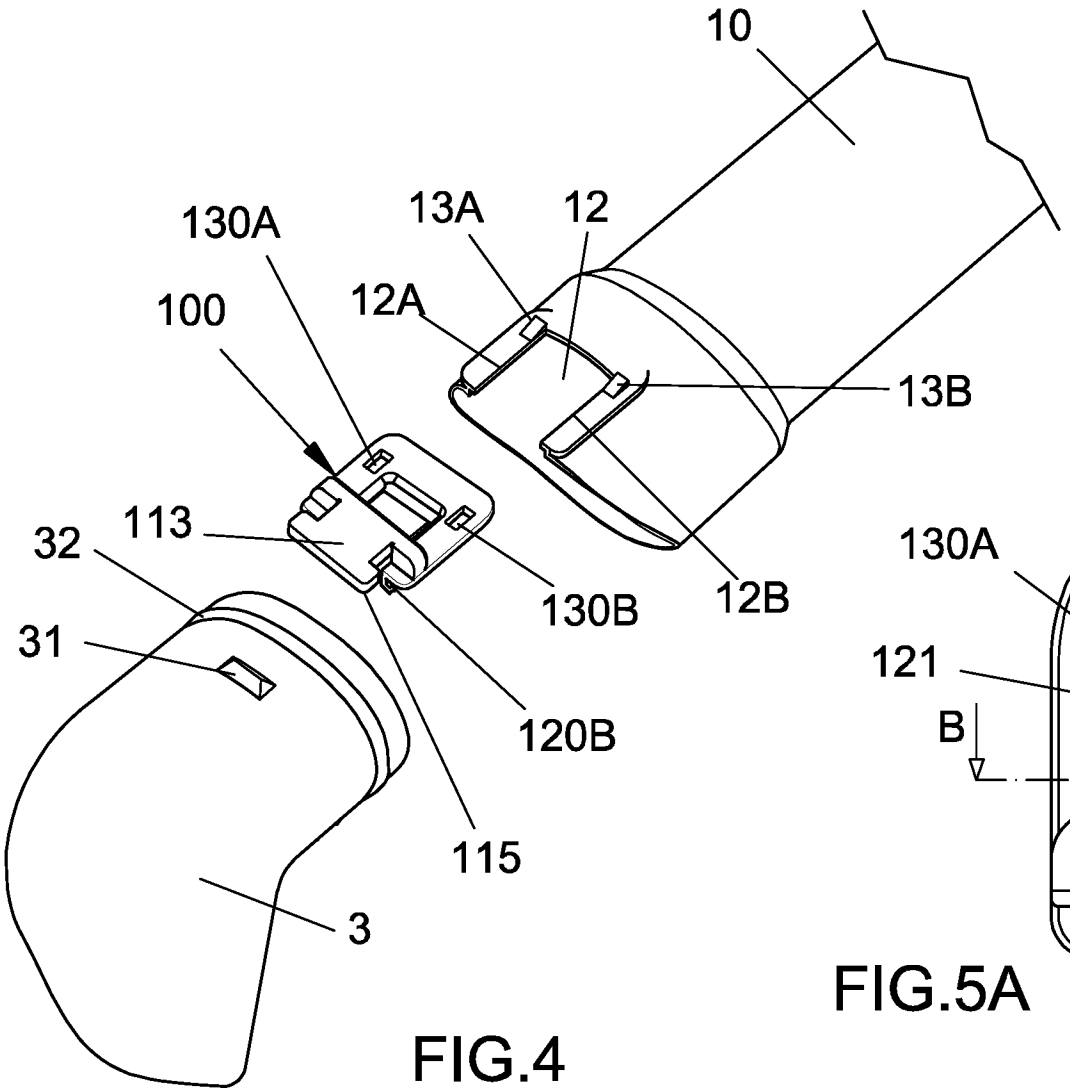
FIG. 4 shows a particular separate perspective view of the connection terminal for connecting the mask body, the hooking means and the breathing tube.
Figure 5B:
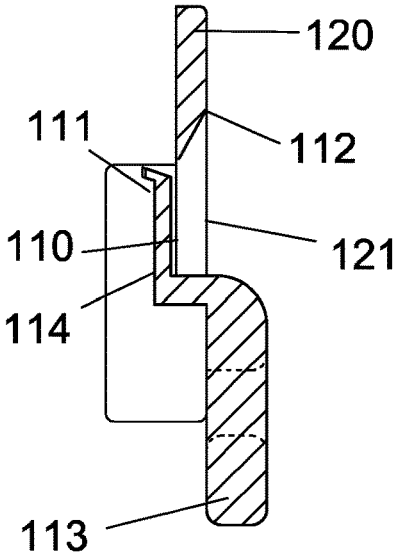
FIG. 5B shows a sectional view of the hooking means along the line A-A of FIG. 5A.
Figure 5C:
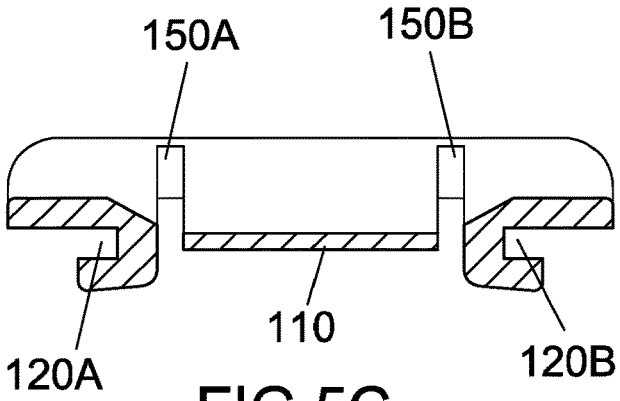
FIG. 5C shows a sectional view of the hooking means along the line B-B of FIG. 5A.
Figure 5D:
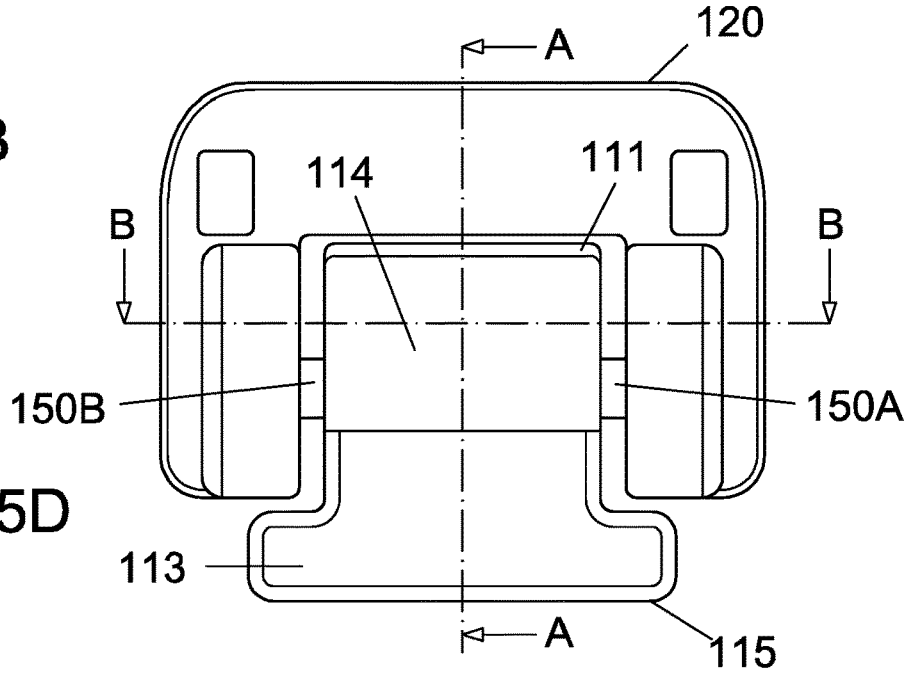
FIG. 5D shows a rear view of the hooking means for hooking the breathing tube to the terminal of the mask body.
Figure 6:
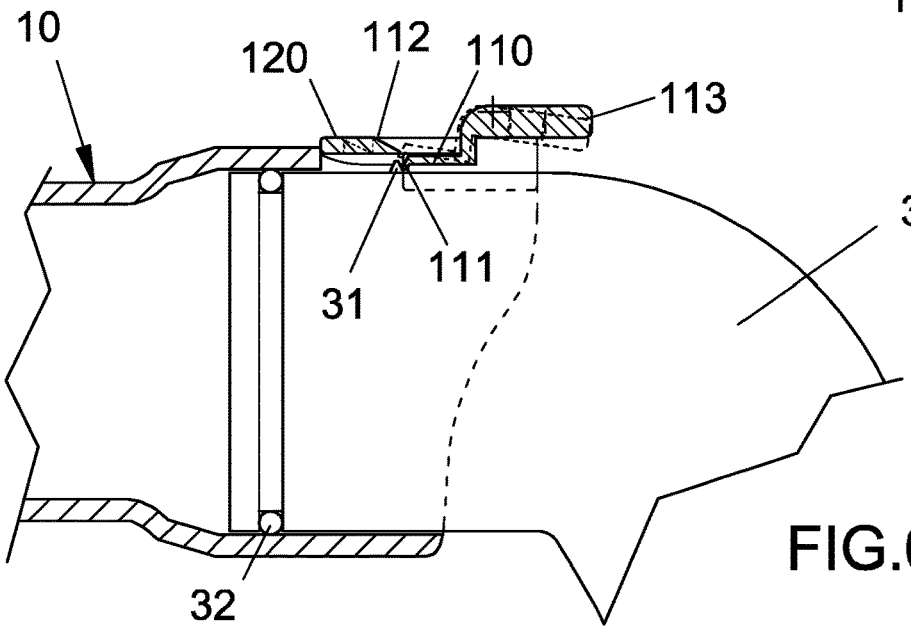
FIG. 6 shows a detailed section of the breathing tube engaged with the connection terminal of the mask body.

With reference to the above-mentioned figures, they show a mask for the activity of surface snorkelling comprising a breathing tube and denoted in its entirety by the reference number 1.

The mask 1 comprises a breathing tube 10, a rigid frame 2 having a connection terminal 3 for removably connecting said breathing tube 10, a transparent visor 4, a soft face shield 5 applicable so as to be tightly sealed against the user's face and having a diaphragm 7 which delimits an upper viewing chamber 8 shaped so as to contain the user's eyes and a lower breathing chamber 9 shaped so as to contain the user's nose and mouth.

The breathing tube 10 has, at the distal end thereof relative to the terminal 3, a one-way valve 11 for blocking the flow of breathing air in the event of immersion in water.

The mask 1 comprises a snap locking means 20 for locking the breathing tube 10 to the terminal 3.

Advantageously and innovatively, the snap locking means 20 for locking the breathing tube 10 to the terminal 3 comprises a separate body 100.

Advantageously, the body 100 is made of plastomeric material that is less rigid than the breathing tube 10.

Advantageously, the body 100 is made in one piece by moulding.

Advantageously, the separate body 100 thus made is independent of any pigments introduced during moulding of the breathing tube 10, hence ensuring the uniformity of the coupling tolerances, also elastic coupling tolerances, of the snap locking means 20 for locking the breathing tube 10 to the terminal 3, irrespective of the colouring of the breathing tube 10.

The body 100 has an outer frame 120 which comprises at least two opposite recesses 120 A and 120 B and at least two engagement holes 130 A and 130 B.

In the terminal part at the edge proximal to the terminal 3, the breathing tube 10 has a recess 12 dimensioned for a sliding coupling with the body 100.

The recess 12 has at least one pair of coupling guides 12 A and 12 B, of a shape and size matching those of the corresponding recesses 120 A and 120 B of the body 100.

At the recess 12, the breathing tube has at least one pair of snap locking teeth 13 A and 13 B, configured and dimensioned for an elastic snap coupling with the corresponding engagement holes 130 A and 130 B present on the outer frame 120 of the body 100.

Advantageously, the outer frame 120 delimits a positioning compartment 121 in the body 100, where there is provided an oscillatable lever 110 provided with a hooking tooth 111 engageable in a hooking seat 31 provided on the terminal 3 of the mask 1.

Advantageously, the body 100 has a limiter 112 for limiting the oscillation stroke of the oscillatable lever 110, defined by the wall of the outer frame 120 delimiting the positioning compartment 121 positioned along the oscillation trajectory of the oscillatable lever 110.

Advantageously, the outer frame 120 has at least two bridges 150 A and 150 B, mutually aligned along a rotation axis of the oscillatable lever 110, which extend towards the inside of the positioning compartment 121 and connect the oscillatable lever 110 to the outer frame 120.

Advantageously, the bridges 150 A and 150 B are formed from thinned portions of the body 100 which act as elastic joints for the oscillatable lever 110.

The oscillatable lever 110 has an arm for picking up movement 113, which extends outside the outer frame 120, and an arm for transferring movement 114 to the hooking tooth 111, which extends inside the outer frame 120.

Conveniently, the wall of the outer frame 120 delimiting the positioning compartment 121 is positioned along the oscillation trajectory of the end of the arm for transferring movement 114 of the oscillatable lever 110, where the hooking tooth 111 is positioned.

The arm for picking up movement 113 and the arm for transferring movement 114 are positioned on two different planes, and the arm for picking up movement 113 has an enlarged end 115.

The functioning of a mask for the activity of surface snorkelling comprising a breathing tube according to the invention appears clear from what has been described and illustrated and, in particular, is substantially as follows.

The body 100 is presented to the recess 12 and the recesses 120 A and 120 B are slidingly engaged with the coupling guides 12 A and 12 B; once the body 100 has been introduced all the way into the recess 12, the engagement holes 130 A and 130 B, positioned in a portion of the outer frame 120 on top of the outer wall of the breathing tube 10 beyond the recess 12, snap engage elastically with the locking teeth 13 A and 13 B, removably locking the body 100 onto the breathing tube 10.

The breathing tube 10 is then presented to the connection terminal 3 for removably connecting the frame 2 of the mask body 1.

The breathing tube 10 has a proximal end with an upper cross-section matching the cross-section of the terminal 3, and is slidingly engaged onto the terminal 3, engaging the sealing gasket 32 by compression and then elastically snap engaging the hooking tooth 111 of the oscillating lever 110 of the body 100 to the hooking seat 31 of the terminal 3.

The breathing tube 10 is thus removably connected to the terminal 3 of the frame 2 of the mask body 1.

In order to remove the breathing tube 10 from the terminal 3, it is sufficient to exert pressure on the enlarged end 115 of the arm for picking up movement 113 of the oscillatable lever 110.

The oscillatable lever 110 rotates around the elastic joints formed by the bridges 150 A and 150 B, lifting the end of the arm for transferring movement 114 where the hooking tooth 111 is positioned, freeing it from engagement with the hooking seat 31 of the terminal 3.

The breathing tube 10 is no longer connected with the terminal 3 and can be conveniently pulled out and freed.

Advantageously, the limiter 112 of the oscillation stroke of the oscillatable lever 110, defined by the wall of the outer frame 120 delimiting the positioning compartment 121 positioned along the trajectory of the end of the arm for transferring movement 114 of the oscillatable lever 110, where the hooking tooth 111 is positioned, acts as a stop to limit the rotation angle of the oscillatable lever 110 around the elastic joints formed by the bridges 150 A and 150 B to the angle necessary for disengagement from the hooking seat 31, thus limiting the twisting of the elastic joints formed by the bridges 150 A and 150 B and safeguarding the integrity thereof In the event of undue damage to the body 100, the latter can be easily replaced.

By acting on the elastic characteristics of the material of the body 100, one frees the two engagement holes 130 A and 130 B from the elastic coupling with the snap locking teeth 13 A and 13 B and by sliding the recesses 120 A and 120 B backwards on the coupling guides 12 A and 12 B, one conveniently pulls out and frees the body 100, which can be replaced with a new intact body 100.

It has in practice is in practice been ascertained that a mask for the activity of surface snorkelling comprising a breathing tube according to the invention is particularly advantageous in that it has an effective, simple, reliable and safe means for removably engaging the breathing tube with the terminal of the mask body.

A further advantage of a mask for the activity of surface snorkelling comprising a breathing tube according to the invention is that it has a means for removably engaging the breathing tube with the terminal of the mask body which is effective irrespective of the pigments introduced into the material for moulding the breathing tube.

Yet a further advantage of the invention is that it has a means for removably engaging with the terminal of the mask body which is easy to connect and elastically removable.

A mask for the activity of surface snorkelling comprising a breathing tube thus conceived is susceptible of numerous modifications and variants, all falling within the scope of the inventive concept, as defined by the claims.

Furthermore, all of the details may be replaced by technically equivalent elements. The materials used, as well as the dimensions, may in practice be any whatsoever according to needs and the state of the art.

What is claimed is:

1. A mask for the activity of surface snorkelling, comprising a breathing tube, a rigid frame having a connection terminal for removably connecting said breathing tube, a transparent visor, a soft face shield applicable so as to be tightly sealed against a user's face and having a diaphragm which delimits an upper viewing chamber shaped so as to contain the user's eyes and a lower breathing chamber shaped so as to contain the user's nose and mouth, and a snap locking means for locking said breathing tube to said terminal, comprising an oscillatable lever provided with a hooking tooth engageable in a hooking seat provided on said terminal, wherein said oscillatable lever is fashioned in a separate body removably fixed to said breathing tube and having a limiter for limiting an oscillation stroke of said oscillatable lever.

2. The mask for the activity of surface snorkelling according to claim 1, wherein said separate body is made of plastomeric material that is less rigid than a material of said breathing tube.

3. The mask for the activity of surface snorkelling according to claim 1, wherein said separate body is made in one piece by moulding.

4. The mask for the activity of surface snorkelling according to claim 1, wherein said separate body has an outer frame delimiting a compartment for positioning said oscillatable lever, and in that it has at least two mutually aligned bridges which extend into said compartment for positioning and connect said oscillatable lever to said outer frame.

5. The mask for the practice of surface snorkelling according to claim 4, wherein said at least two bridges are aligned along a rotation axis of said oscillatable lever.

6. The mask for the activity of surface snorkelling according to claim 4, wherein said at least two bridges are formed from thinned portions of said separate body which act as elastic joints.

7. The mask for the activity of surface snorkelling according to claim 4, wherein said limiter for limiting the oscillation stroke is defined by a wall of said outer frame positioned along an oscillation trajectory of said oscillatable lever.

8. The mask for the activity of surface snorkelling according to claim 7, wherein said oscillatable lever has an arm for picking up movement, which extends outside said outer frame, and an arm for transferring movement to said hooking tooth, which extends inside said outer frame.

9. The mask for the activity of surface snorkelling according to claim 8, wherein said wall of said outer frame defining said limiter is positioned along an oscillation trajectory of a free end of said arm for transferring movement.

10. The mask for the activity of surface snorkelling according to claim 9, wherein said hooking tooth is positioned at said free end of said arm for transferring movement.

11. The mask for the activity of surface snorkelling according to claim 8, wherein said arm for picking up movement and said arm for transferring movement are positioned on two different planes.

12. The mask for the activity of surface snorkelling according to claim 8, wherein said arm for picking up movement has an enlarged end.

13. The mask for the activity of surface snorkelling according to claim 7, wherein said outer frame has at least a pair of engagement holes for snap locking teeth present on said breathing tube.

14. The mask for the activity of surface snorkelling according to claim 13, wherein said at least a pair of engagement holes are in a portion of said outer frame that overlies a wall of said breathing tube.

15. The mask for the activity of surface snorkelling according to claim 4, wherein said outer frame has at least a pair of guides for slidably coupling said body in a recess of a terminal of said breathing tube.

* * * * *